United States Patent [19]

Caskey

[11] Patent Number: 4,693,309

[45] **Date of Patent: * Sep. 15, 1987**

[54] WIRELINE SET/TUBING RETRIEVABLE BRIDGE PLUG

[75] Inventor: Kenneth D. Caskey, Duncan, Okla.

[73] Assignee: Halliburton Company, Duncan, Okla.

[ * ] Notice: The portion of the term of this patent subsequent to Mar. 10, 2004 has been disclaimed.

[21] Appl. No.: 831,249

[22] Filed: Feb. 19, 1986

Related U.S. Application Data

[63] Continuation-in-part of Ser. No. 750,557, Jun. 27, 1985, Pat. No. 4,648,446.

[51] Int. Cl.[4] ..... E21B 23/06

[52] U.S. Cl. ..... 166/123; 166/134; 166/183

[58] Field of Search ..... 166/123, 134, 181, 182, 166/183, 192

[56] References Cited

U.S. PATENT DOCUMENTS

| | | | |
|---|---|---|---|
| 3,244,233 | 4/1966 | Villalon, Jr. | 166/123 |
| 3,507,327 | 4/1970 | Chenoweth | 166/134 |
| 3,584,684 | 6/1971 | Anderson et al. | 166/129 |
| 3,643,737 | 2/1972 | Current et al. | 166/216 |
| 3,722,588 | 3/1973 | Tamplen | 166/182 |
| 3,749,166 | 7/1973 | Young | 166/123 |
| 3,749,167 | 7/1973 | Young | 166/217 |
| 4,044,826 | 8/1977 | Crowe | 166/182 |
| 4,078,606 | 3/1983 | Montgomery | 166/120 |
| 4,427,063 | 1/1984 | Skinner | 166/134 |
| 4,518,037 | 5/1985 | Youngblood et al. | 166/182 |
| 4,526,229 | 7/1985 | Pickerson | 166/182 |
| 4,545,431 | 10/1985 | Fore | 166/183 |

*Primary Examiner*—Stephen J. Novosad
*Assistant Examiner*—William P. Neuder
*Attorney, Agent, or Firm*—James R. Duzan

[57] ABSTRACT

A wireline set and tubing retrievable bridge plug. The bridge plug includes a central mandrel portion having a plurality of J-shaped recesses thereon at an upper end and at least one shaped recess at a lower end thereof. Disposed around the central mandrel is a packer mandrel having a packer element thereon and slips disposed therearound. A ratchet assembly is provided for holding the apparatus in a set position in which the packer element sealingly engages the well bore and the slips grippingly engage the well bore. The shaped lower recess in the central mandrel is disposed below the ratchet mechanism. A packer mandrel case having a lug therein for engaging the shaped recess is disposed around the lower end of the mandrel. The slips, ratchet mechanism and J-shaped recess are all positioned below the packer element for protection from debris in the well bore. A retrieving tool attached to a tubing string is used to retrieve the bridge plug. The retrieving tool opens a bypass passage through the bridge plug for facilitating removal from the well bore.

20 Claims, 9 Drawing Figures

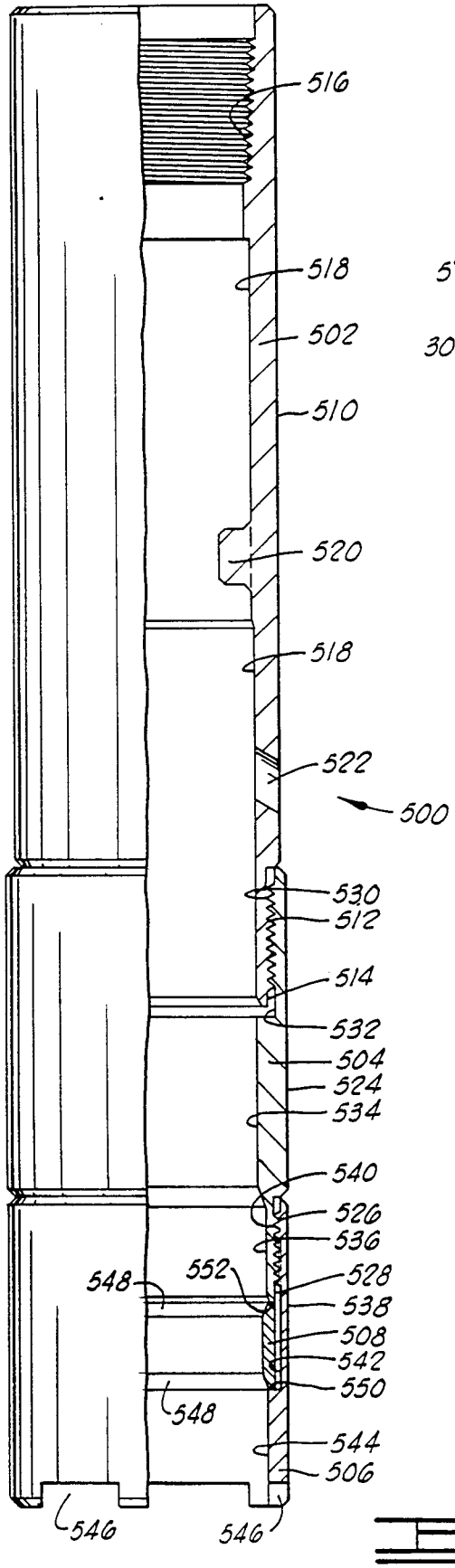
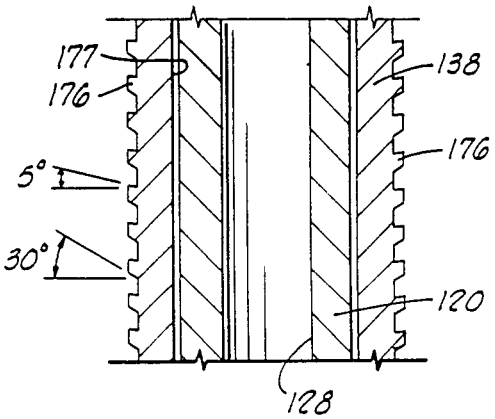
FIG. 4
FIG. 5

WIRELINE SET/TUBING RETRIEVABLE BRIDGE PLUG

This application is a continuation-in-part of U.S. patent application Ser. No. 750,557, filed June 27, 1985, now U.S. Pat. No. 4,648,446, by Fore and Caskey, assigned to the assignee of the present invention.

BACKGROUND OF THE INVENTION

1. Field Of The Invention

This invention relates to bridge plugs for use in wells, and more particularly, to a packer-type bridge plug which may be set upon a wireline and retrieved upon a tubing string for use in wells.

2. Description Of The Prior Art

In oil and gas wells it is desirable to have a bridge plug which will withstand high differential fluid pressures thereacross, can be set using a wireline and can be easily retrieved from the well. Such a bridge plug is particularly deirable when wells with multiple formations are to be isolated for completion, testing and/or stimulation.

One bridge plug so designed is disclosed in U.S. Pat. No. 4,545,431 to Fore, assigned to the assignee of the present invention. One problem with the apparatus of Fore is that some portions of the bypass passages therein are open above the packer element. Sand may settle on top of the set bridge plug, blocking these passages and getting into the apparatus. This can prevent proper actuation and cause difficulties on retrieval. In the present invention, all bypass passages are always closed prior to retrieval. Also, the ratchet, slips and J-slot are below the packer and thus protected.

Other typical prior art retrievable packers and bridge plugs are disclosed in U.S. Pat. Nos. 3,244,233; 3,507,327; 3,584,684; 3,749,166; 4,078,606; and 4,427,063.

SUMARY OF THE INVENTION

The wireline set and tubing retrievable bridge plug of the present invention comprises mandrel means having a shaped recess thereon, packer mandrel means disposed around the mandrel means and comprising first ratchet means thereon, ratchet body means disposed around the packer mandrel means and comprising second ratchet means thereon for releasably engaging the first ratchet means, mandrel case means disposed around the mandrel means and having lug means thereon for engaging the shaped recess in the mandrel means, packer means on the packer mandrel means for releasably, sealingly engaging a well bore, and slip means for releasably, grippingly engaging the well bore.

Preferably, the mandrel case means is shearably attached to the packer mandrel means, and the recess and lug means are positioned below the ratchet body means.

The mandrel means comprises means thereon for selectively engaging the second ratchet means with the first ratchet means and disengaging the second ratchet means from the first ratchet means corresponding to a relative position of the mandrel means with respect to the packer mandrel means. The tool preferably comprises biasing means for biasing the ratchet body means toward the position in which the second ratchet means is engaged with the first ratchet means.

The slip means comprises upper wedge means, lower wedge means spaced from the upper wedge means, and a plurality of slips disposed between the upper and lower wedge means. The slips are engaged with the upper and lower wedge means when in a set position engaging the well bore. At least one of the upper and lower wedge means comprises ratchet enclosure means for enclosing and locating the ratchet body means. The bridge plug further comprises slip retainer means for retaining the slips and having a portion disposed about the upper wedge means and another portion disposed about the lower wedge means. The slip retaining means defines a plurality of apertures therein for permitting extension of a portion of a corresponding slip therethrough. Preferably, the slip retainer means is attached to one of the upper and lower wedge means and is slidable with respect to the other of the upper and lower wedge means.

The mandrel means is best characterized by a J-slot mandrel having a shaped recess therein, and the mandrel case means is best characterized by a substantially cylindrical case having a stud threadingly engaged therewith. The stud has a lug portion which extends inwardly for engagement with a recess in the mandrel.

The first ratchet means is best characterized by an external ratchet groove surface on the packer mandrel, and the second ratchet means is best characterized by an internal ratchet groove surface on the ratchet body means.

Bypass means are provided for bypassing fluid through the bridge plug as the bridge plug is retrieved from the well bore. The bypass means comprises a bypass body attached to the J-slot mandrel having flow passages therethrough in communication with a central opening through the mandrel. A release sleeve valve is disposed around the bypass body and slidable with respect thereto. The release sleeve valve is moved to an open position when the bridge plug is retrieved by a retrieving tool.

An important object of the invention is to provide a wireline set and tubing retrievable bridge plug having ratchet means, slips and a J-slot therein which are protected from debris in the well bore by being positioned below a packer element.

Another object of the invention is to provide a bridge plug having a J-slot on a central mandrel therein and a mandrel case disposed around the mandrel and having a lug for engaging the J-slot.

A further object of the invention is to provide a bridge plug with a ratchet assembly and a J-slot positioned below the ratchet assembly.

Still another object of the invention is to provide a bridge plug which can be set on a wireline and retrieved on a tubing string.

Additional objects and advantages of the invention will become apparent as the following detailed description of the preferred embodiment is read in conjunction with the accompanying drawings which illustrate such preferred embodiment.

BRIEF DESCRIPTION OF THE DRAWINGS

FIG. 4 is a view of a portion of the ratchet thread on the packer mandrel.

FIG. 5 shows the retrieving tool used to retrieve the bridge plug of the present invention from a well.

DESCRIPTION OF THE PREFERRED EMBODIMENT

Figure 1A:
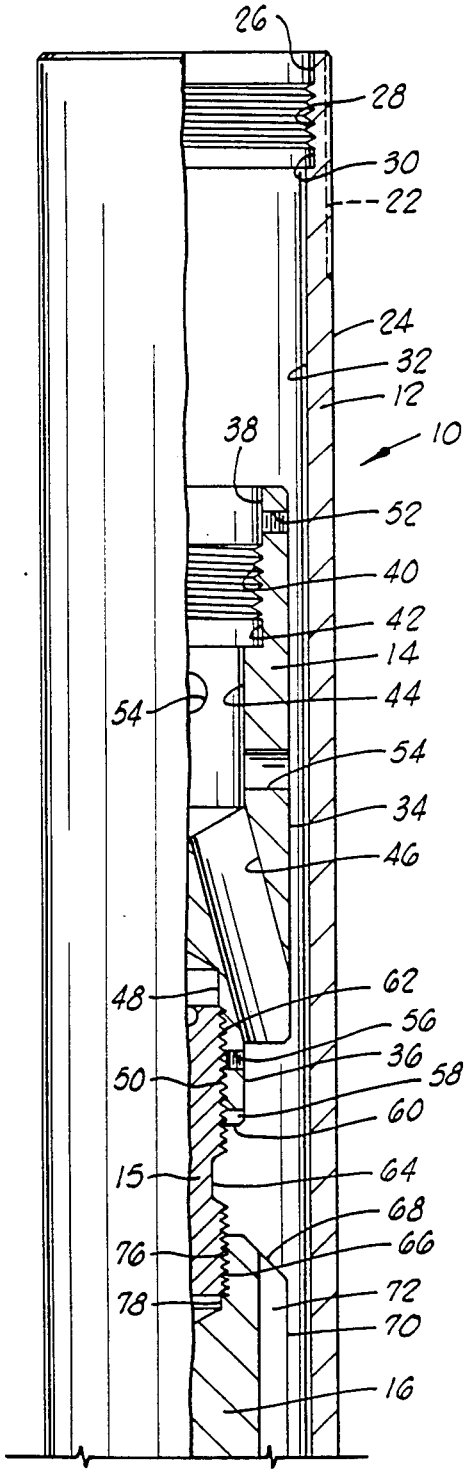
FIGS. 1A–1E illustrate the wireline set/tubing retrievable bridge plug of the present invention as it is run into the well bore.

Referring now to the drawings, and more particularly to FIGS. 1A–1E, the wireline set/tubing retrievable bridge plug of the present invention is shown and generally designated by the numeral 10.

In FIG. 1A, a portion of bridge plug 10 is shown, including a portion of setting sleeve 12, adapter 14, tension stud 15, and a portion of J-slot receiving mandrel 16.

Setting sleeve 12 comprises an elongated annular cylindrical member having, on the exterior thereof, a plurality of wrenching flats 22 and cylindrical surface 24 and, on the interior thereof, first annular recess 26, threaded bore 28, second annular recess 30 and cylindrical bore 32.

Adapter 14 comprises a cylindrical member having, on the exterior thereof, first cylindrical exterior surface 34 and second cylindrical exterior surface 36 and, on the interior thereof, first annular recess 38, first threaded bore 40, second annular recess 42, first cylindrical blind bore 44, a plurality of angled, substantially longitudinally disposed cylindrical bores 46 which allow fluid communication between bore 44 and the exterior of adapter 14, second cylindrical blind bore 48 and second threaded bore 50. Adapter 14 further includes first threaded aperture 52, a plurality of apertures 54 which allow fluid communication between bore 44 and the exterior of adapter 14, second threaded aperture 56, and annular recess 58 in end 60 of the adapter.

Tension stud 15 comprises a cylindrical member having a first threaded end 62 which releasably, threadably engages second threaded bore 50 of adapter 14, a reduced diameter portion 64 and a second threaded end 66.

The portion of J-slot retrieving mandrel 16 shown in FIG. 1A comprises a cylindrical member having, on the exterior thereof, frusto-conical annular surface 68 and first cylindrical surface 70 having, in turn, a plurality of J-shaped recesses or J-slots 72 therein and, on the interior thereof, a threaded bore 76 releasably, threadedly engaged by threaded end 66 of tension stud 16 and a blind bore 78 in the upper end thereof.

Figure 1B:
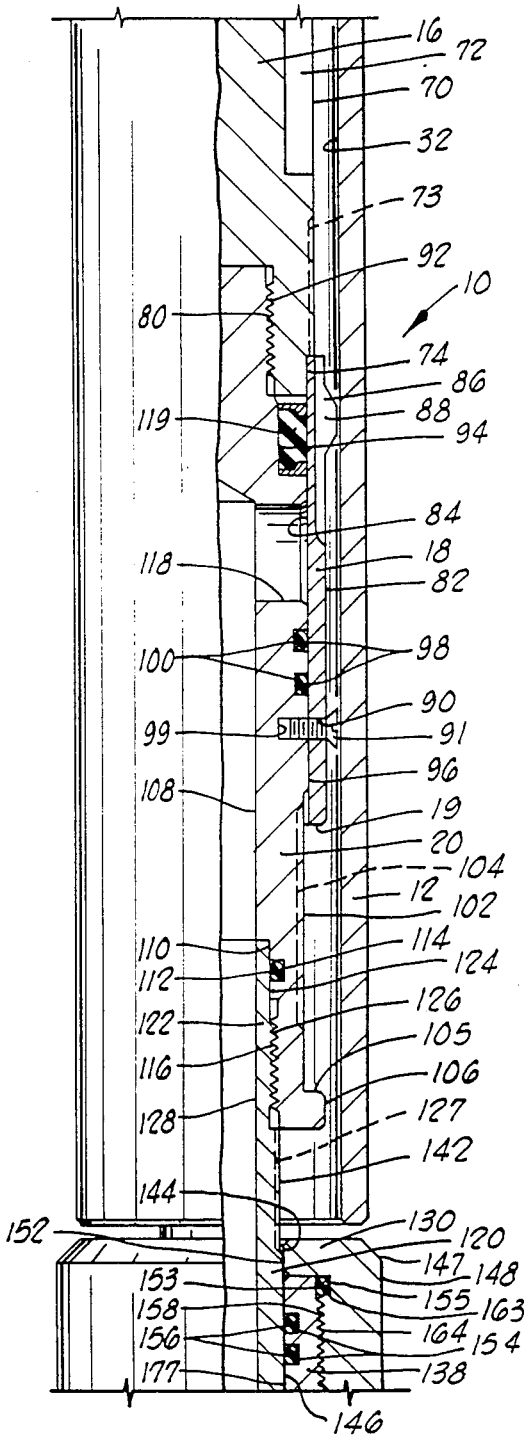

Referring now to FIG. 1B, a further portion of bridge plug 10 is shown including the remaining portion of J-slot retrieving mandrel 16, release valve sleeve 18, release valve or bypass body 20, a portion of central J-slot mandrel 120, the remaining portion of setting sleeve 12 and a portion of upper packer shoe 130.

The remaining portion of J-slot retrieving mandrel 16 comprises an elongated cylindrical member having, on the exterior thereof, first cylindrical surface 70 having, in turn, J-shaped recesses 72 and wrenching flats 73 therein, and second cylindrical surface 74 and, on the interior thereof, second threaded bore 80.

Release valve sleeve 18 has a lower end 19 and comprises an elongated cylindrical annular member having, on the exterior thereof, cylindrical surface 82, and on the interior thereof, bore 84. Release valve sleeve 18 further includes on the upper end, a plurality of longitudinal recesses or grooves 86, an annular rib 88 thereon and at least one threaded aperture 90 therethrough. Each aperture 90 has a portion of a shear pin 91 threadedly engaged therewith.

Bypass body 20 comprises an elongated cylindrical member having, on the exterior thereof, threaded surface 92 which is releasably, threadedly engaged with threaded bore 80 of J-slot retrieving mandrel 16, first cylindrical surface 94, second cylindrical surface 96 having a plurality of first annular recesses 98 therein containing annular elastomeric seals 100 therein which slidingly, sealingly engage bore 84 of release valve 18 and a second annular recess 99, third cylindrical surface 102 having wrenching flats 104 therein, shoulder 105 and fourth cylindrical surface 106 and, on the interior thereof, blind bore 108, first cylindrical bore 110 having, in turn, annular recess 112 therein containing annular elastomeric seals 114 therein and threaded bore 116. Bypass body 20 further includes a plurality of apertures 118 which allow fluid communication between blind bore 108 and the exterior of bypass body 20 as hereinafter discussed in more detail.

Installed on first cylindrical surface 94 of bypass body 20 is elastomeric member 119 which resiliently outwardly biases, and sealingly engages, interior bore 84 of release valve sleeve 18 adjacent recesses 86 when sleeve 18 is in a first position on bypass body 20.

Release valve sleeve 18 is releasably retained on bypass body 20 by threaded shear pin 91 having a body portion thereof extending into annular recess 99 in the bypass body.

Further shown in FIG. 1B is upper end 122 of J-slot mandrel 120. Upper end 122 of J-slot mandrel 120 comprises an elongated annular member having, on the exterior thereof, first cylindrical surface 124 which slidingly, sealingly engages seal 114 in first bore 110 of bypass body 20, first threaded surface 126 which threadedly, releasably engages threaded bore 116 of bypass body 20, second cylindrical surface 142 having wrenching flats 127 therein, first frusto-conical surface 144, and a portion of third cylindrical surface 146 and, on the interior thereof, bore 128.

Also shown in FIG. 1B is a portion of upper packer shoe 130 comprising an annular cylindrical member having on the exterior thereof, frusto-conical surface 147, first cylindrical surface 148 and, on the interior thereof, first cylindrical bore 152, annular recess 153 having seal 155 therein, and threaded bore 158.

In FIG. 1B, a portion of packer mandrel 138 is shown including, on the exterior thereof, cylindrical surface 163, threaded surface 164 threadedly engaged with threaded bore 158 of upper packer shoe 130 and, on the interior thereof, cylindrical bore 177 having annular recesses 154 therein having seals 156 therein which slidingly, sealingly engage third cylindrical surface 146 of J-slot mandrel 120.

Figure 1C:
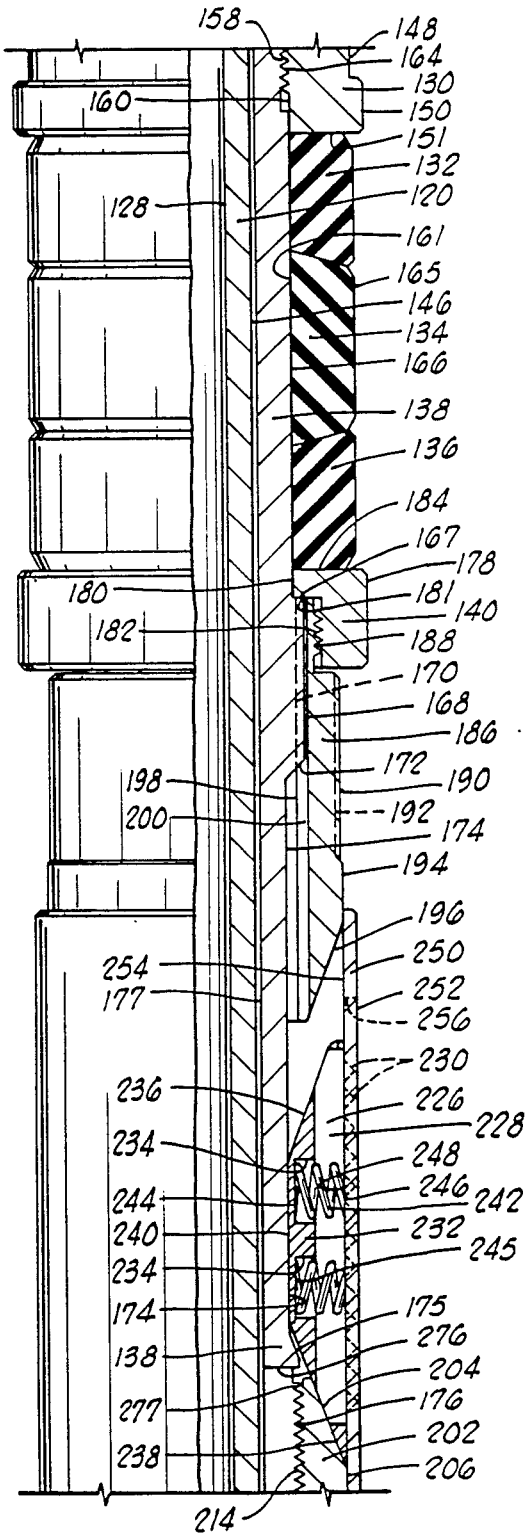

Referring now to FIG. 1C, another portion of bridge plug 10 is shown including another portion of J-slot mandrel 120, the remaining portion of upper mandrel shoe 130, packer elements 132, 134 and 136, another portion of packer mandrel 138, lower packer shoe 140, upper wedge 186, slips 226, slip retainer sleeve 250, and a portion of lower wedge 202.

The remaining portion of J-slot mandrel 120 shown in FIG. 1C comprises an elongated cylindrical annular member having, on the exterior thereof, third cylindrical surface 146 and, on the interior thereof, cylindrical bore 128 therethrough.

The remaining portion of upper packer shoe 130 comprises an annular cylindrical member having, on the exterior thereof, first cylindrical surface 148 and second cylindrical surface 150 and, on the interior thereof, threaded bore 158 and second cylindrical bore 160. Lower end 151 of upper packer shoe 130 contacts packer element 132.

Packer elements 132, 134 and 136 each comprise an annular elastomeric member having a bore 161 therethrough. Exterior surface 165 thereof is adapted for sealing engagement with a well bore as hereinafter described.

The portion of packer mandrel 138 shown in FIG. 1C comprises an elongated annular cylindrical member having, on the exterior thereof, threaded surface 164 which is threadedly engaged with threaded bore 158 of upper packer shoe 130, second cylindrical surface 166, shoulder 167, third cylindrical surface 168 having a plurality of substantially longitudinal spline members 170 therealong, first frusto-conical annular surface 172, fourth cylindrical surface 174, second frusto-conical annular surface 175 and threaded ratchet groove surface 176. On the interior of packer mandrel 138 is bore 177.

Lower packer shoe 140 comprises an annular cylindrical member having, on the exterior thereof, cylindrical surface 178 and, on the interior thereof, cylindrical surface 108, shoulder 181 and threaded bore 182. Upper end 184 of lower packer shoe 140 contacts packer element 136.

As shown in FIG. 1C, an upper wedge member 186 comprises an annular cylindrical member having, on the exterior thereof, threaded surface 188 threadedly, releasably engaged with threaded bore 182 in lower packer shoe 140, first cylindrical surface 190 having a plurality of wrenching flats 192 therein, second cylindrical surface 194 and frusto-conical surface 196 and, on the interior thereof, bore 198 having a plurality of longitudinal spline members thereon slidably engaged with spline members 170 in packer mandrel 138.

Figure 1D:
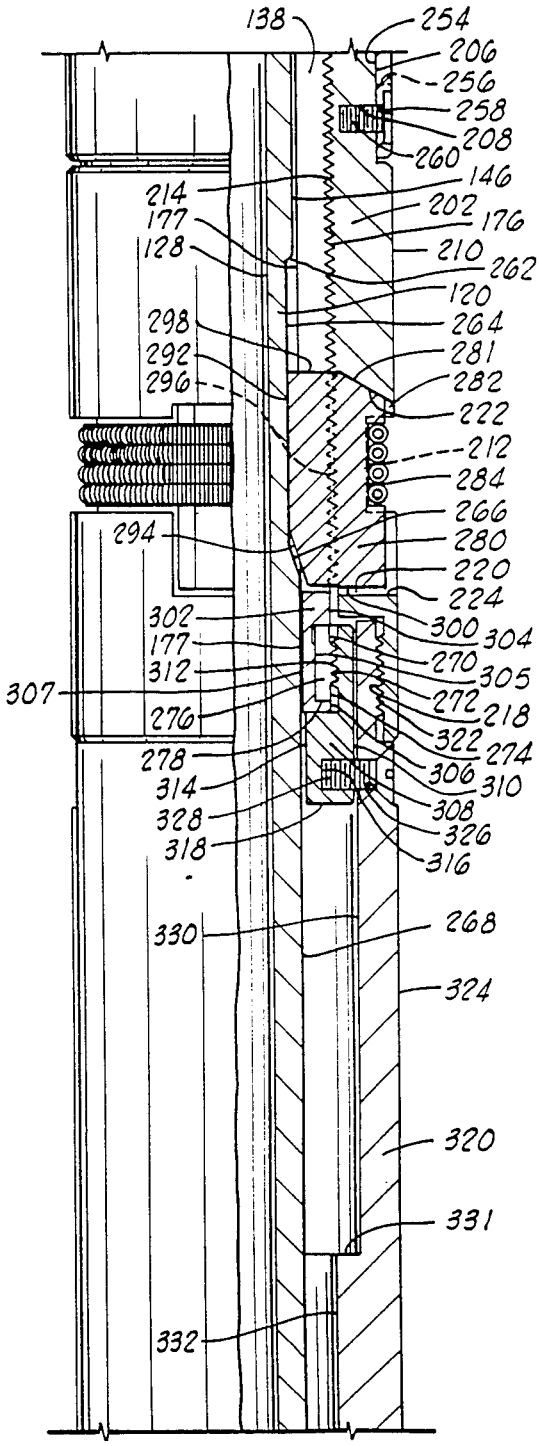

Referring now to FIGS. 1C and 1D, lower wedge member 202 comprises an elongated, annular cylindrical member having, on the exterior thereof, frusto-conical annular surface 204, first cylindrical surface 206 having, in turn, at least one threaded aperture 208 therein, second cylindrical surface 210 and third cylindrical surface 212 forming a recess in surface 210 and, on the interior thereof, a bore 214 and a left-hand threaded bore 218. Lower wedge member 202 defines a plurality of rectangular-shaped apertures 220 therethrough having, in turn, an angular top end surface 222 and a bottom end surface 224.

Slips 226, shown in FIGS. 1C and 1D, each comprise an arcuate rectangular-shaped member having a rectangular raised side portion 228 having a plurality of teeth 230 thereon and, on the center of raised side portion 228, a spring guide portion 232 having, in turn, a pair of spring-receiving recesses 234 therein. Upper end 236 and lower end 238 of each slip 226 are formed having frusto-conical arcuate surfaces which are complimentary to and slidingly engage frusto-conical annular surface 196 of upper wedge member 186 and frusto-conical annular surface 204 of lower wedge member 202, respectively. Each slip 226 further includes arcuate interior surface 240 which slidingly engages second cylindrical surface 174 of packer mandrel 138.

Disposed in each spring receiving recess 234 in spring guide 232 is a helical coil spring 242 having a first end 244 bearing against a spring seat surface 245 and a second end 246 bearing against inner surface 248 of slip retainer sleeve 250. Springs 242 thus bias slips 226 inwardly toward packer mandrel 138.

Slip retainer sleeve 250, also shown in FIGS. 1C and 1D, provides means for retaining and guiding slips 226 and comprises an elongated, annular cylindrical member having, on the exterior thereof, cylindrical surface 252 and, on the interior thereof, bore 254. Slip retainer sleeve 250 further includes a plurality of elongated rectangular apertures 256 therethrough and at least one aperture 258 which receives a portion of threaded member 260 therein to releasably retain slip retainer sleeve 250 to lower wedge member 202. Threaded member 260 threadingly engages threaded aperture 208 in lower wedge member 202.

Referring now to FIG. 1D, the portion of J-slot mandrel 120 shown comprises, on the exterior thereof, third cylindrical surface 146, second frusto-conical surface 262, fourth cylindrical surface 264, third frusto-conical surface 266 and fifth cylindrical surface 268 and, on the interior thereof, bore 128.

The remaining portion of packer mandrel 138 shown in FIG. 1D comprises, on the exterior thereof, threaded ratchet groove surface 176, fifth cylindrical surface 270, threaded surface 272 and seventh cylindrical surface 274, and on the interior thereof, bore 177. Packer mandrel 138 further includes a plurality of elongated slots 276 therethrough. The upper portion of slots 276 is shown in FIG. 1C and the lower portion in FIG. 1D. Slots 276 extend from approximately upper end 277 of threaded surface 176 to lower end 278 of packer mandrel 138. Slips 276 are aligned with apertures 220 in lower wedge member 202.

A plurality of ratchet blocks 280 are disposed in apertures 220 and lower wedge member 202 and extend into corresponding slots 276 in packer mandrel 138. Each ratchet block 280 comprises a rectangular-shaped member having, on the exterior thereof, chamfered surface 281 conforming to surface 222 in lower wedge member 202, outer surface 282 having, in turn, a rectangular recess 284 therein containing resilient, annular garter springs 286 and, on the interior thereof, arcuate smooth surface 292, chamfered surface 294 and arcuate threaded ratchet groove surfaces 296 which are complimentary to ratchet groove surface 176 on packer mandrel 138. In the run-in configuration shown in FIGS. 1A–1E, only a few ratchet groove surfaces 176 and 296 are initially engaged. Each ratchet block 140 further includes upper end surface 298 and lower end surface 300. Bottom surface 300 is complimentary to bottom surface 224 of aperture 220 in lower wedge member 202.

Disposed adjacent lower end 278 of packer mandrel 138 is an annular support ring 302 having, on the exterior thereof, first cylindrical surface 304, second cylindrical surface 305, and third cylindrical surface 306, and, on the interior thereof, bore 307.

A connecting collar 308 has on the exterior thereof first cylindrical surface 310 and, on the interior thereof, threaded bore 312 which is releasably, threadedly engaged with threaded surface 304 on ring 302 and bore 314. A second cylindrical surface 316 defines a recess extending inwardly from first cylindrical surface 310 of connecting collar 308. Connecting collar 308 has a bottom end 318.

Also shown in FIG. 1D is a portion of a J-slot case 320 comprising an elongated annular, cylindrical member having, on the exterior thereof, threaded surface 322 which is threadedly, releasably engaged with threaded bore 218 of lower wedge member 202 and cylindrical surface 324 having, in turn, a threaded aperture 326 therethrough which threadedly receives a portion of a threaded shear pin 328 therein. Shear pin 328 has a portion thereof extending into the recess formed by second cylindrical surface 316 of connecting collar 308. On the interior of J-slot case 320 shown in FIG. 1D are first bore 330, shoulder 331 and second bore 332.

Figure 1E:
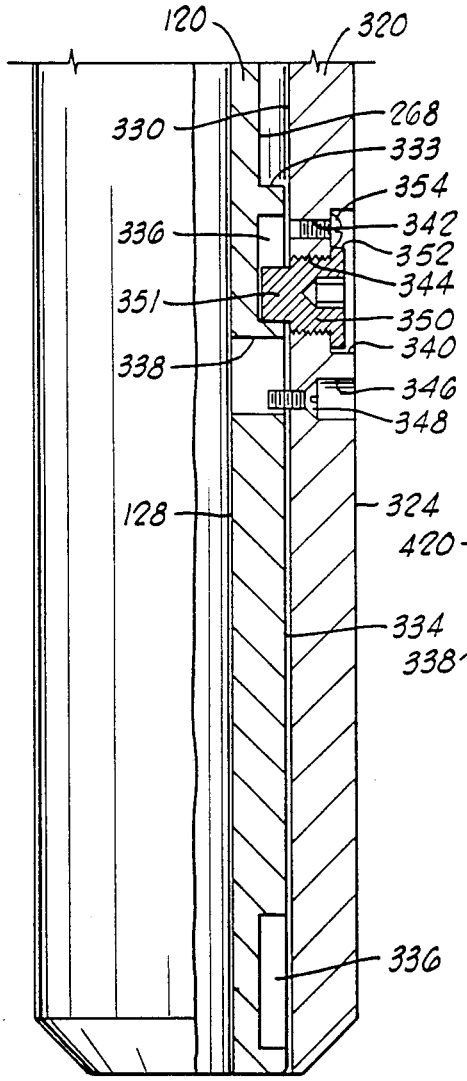

Referring now to FIG. 1E, the remaining portion of J-slot mandrel 120 is shown as comprising an elongated cylindrical annular member having, on the exterior thereof, fifth cylindrical surface 268, shoulder 333 and sixth cylindrical surface 334 having, in turn, at least one J-shaped recess or J-slot 336 formed therein and an aperture or slot 338 therethrough and, on the interior thereof, cylindrical bore 128 therethrough.

The remaining portion of J-slot case 320 shown in FIG. 1E comprises an annular cylindrical member having, on the exterior thereof, cylindrical surface 324 having, in turn, a counterbore 340 therein with a first threaded, small aperture 342 therethrough and a second threaded, large aperture 344 therethrough. Cylindrical surface 324 further has a threaded aperture 346 therethrough into which is threadingly engaged a shear pin 348 having a portion thereof extending into aperture 338 in J-slot mandrel 120 and, on the interior thereof, cylindrical bore 330 therethrough. Releasably received in aperture 344 is a threaded stud 350 having a lug portion 351 thereof extending into J-slot 336 in J-slot mandrel 120 and providing lug means for engaging the J-slot. Stud 350 has a notch 352 in an outside edge thereof, and threaded member 354 is threaded into aperture 342 such that a head portion thereof fits into notch 352, thus locking stud 350 in place and preventing undesired rotation thereof.

Figure 2:
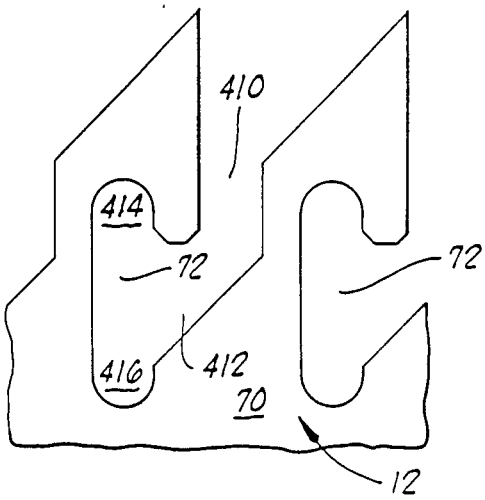
FIG. 2 is an unwrapped view of a portion of the J-slot configuration of the J-slot retrieving mandrel which is used to retrieve the bridge plug.

Referring now to FIG. 2, J-shaped recesses 72 in J-slot retrieving mandrel 16 are shown. Each J-shaped recess is formed having an entry portion 410, ramp portion 412, upper portion 414 and lower portion 416.

Figure 3:
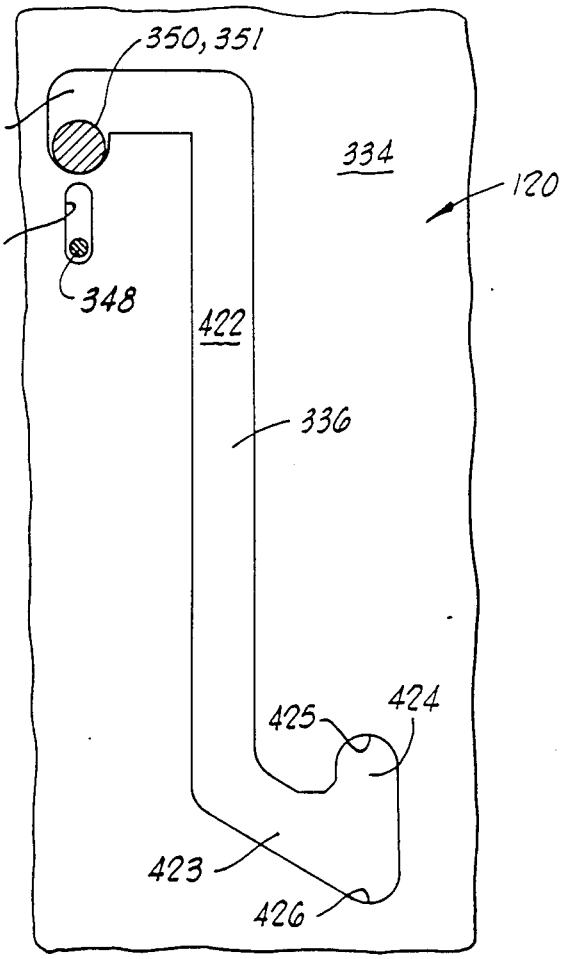
FIG. 3 is an unwrapped view of a portion of the J-slot configuration in the lower end of the J-slot mandrel which is used to release the ratchets and unset the slips during retrieval.

Referring to FIG. 3, J-slot 336 in J-slot mandrel 120 is shown. Each J-slot 336 is formed having an upper portion 420, transition portion 422, ramp portion 423 and lower portion 424. Aperture 338 is also shown in FIG. 3.

Referring now to FIG. 4, a portion of threaded ratchet groove surface 176 on packer mandrel 138 is shown. The ratchet thread may be of any convenient pitch and diameter. A thread having a 30° angle with respect to the vertical plane of the leading face of the thread and a 5° angle with respect to the vertical plane of the trailing face of the thread is preferred. Arcuate threaded surface 296 of ratchet blocks 280 are similarly formed.

Referring now to FIG. 5, retrieving tool 500 for the retrieval of bridge plug 10 of the present invention is shown. Retrieving tool 500 comprises an overshot member 502, upper ring spring holder 504, lower ring spring holder 506 and ring spring 508.

Overshot member 502 comprises an elongated cylindrical annular member having, on the exterior thereof, first cylindrical surface 510, threaded surface 512, and second cylindrical surface 514 and, on the interior thereof, threaded bore 516 and bore 518 having, in turn, a plurality of inwardly directed lugs 520 located thereon. Overshot member 502 further includes a plurality of apertures 522 for allowing fluid communication from the exterior thereof to the interior thereof.

Upper ring spring holder 502 comprises an elongated cylindrical annular member having, on the exterior thereof, first cylindrical surface 524, threaded surface 526 and second cylindrical surface 528 and, on the interior thereof, threaded bore 520 which threadedly, releasably engages threaded surface 512 of overshot member 502, first bore 532, second bore 534 and third bore 536.

Lower ring spring holder 506 comprises an elongated cylindrical annular member having, on the exterior thereof, cylindrical surface 538 and, on the interior thereof, threaded bore 540 which threadedly engages threaded surface 526 of upper ring spring holder 504, first bore 542 and second bore 544. Lower ring spring holder 506 further includes a plurality of recesses 546 in one end thereof.

Ring spring 508 comprises an annular ring spring having annular frusto-conical annular surfaces 548 therein. Ring spring 502 is retained within first bore 542 of lower ring spring holder 506 having one end thereof abutting annular shoulder 550 of lower ring spring holder 506 while the other end thereof abuts end 552 of upper ring spring holder 504 when holder 504 is secured to holder 506.

OPERATION OF THE INVENTION

Referring to FIGS. 1A–1E, to set bridge plug 10 of the present invention a Baker Model "E-4" Wireline Pressure Setting Assembly, as sold by the Baker Oil Tool Company of Houston, Tex., is used. The Baker Model "E-4" setting assembly is threadedly connected to threaded bore 28 of setting sleeve 12 and threaded bore 40 of adapter 14.

When the Baker Model "E-4" setting assembly is actuated, the setting assembly causes relative motion between setting sleeve 12 and adapter 14. Initially, upon actuation of the Baker Model "E-4" setting assembly, the setting assembly pulls upwardly on adapter 14 relative to setting sleeve 12. This relative motion causes shearing of shear pins 328, originally securing packer mandrel 138 to J-slot case 320. Upon shearing of shear pins 328, the upward movement by adapter 14 causes corresponding upward movement of J-slot retrieving mandrel 16, bypass body 20, J-slot mandrel 120, J-slot case 320 and lower wedge member 202. As lower wedge member 202 moves relatively upwardly toward contact with upper wedge member 186, slips 226, acting as slip means, are cammed or wedged outwardly by lower wedge member 202 and upper wedge member 186 into engagement with the casing in the well bore. Thus, wedge members 186 and 202 provide wedge means for actuating the slip means. This movement also causes ratchet blocks 280 to engage ratchet groove 176 on packer mandrel 138. Lower end 318 of connecting collar 308 is moved adjacent shoulder 331 in J-slot case 320.

At the point when slips 226 engage the casing in the well bore, the Baker Model "E-4" setting assembly causes downward movement of setting sleeve 12, upper packer shoe 130, packer mandrel 138 and packer elements 132, 134 and 136 relative to retrieving J-slot mandrel 16, bypass body 20, J-slot mandrel 120, lower packer shoe 140, upper wedge member 186, lower wedge member 202 and J-slot case 320.

This downward movement of setting sleeve 12, upper packer shoe 130 and packer elements 132, 134 and 136, causes the packer elements to be compressed into engagement with the casing in the well bore, providing packer means for sealing the well bore.

As packer elements 132, 134 and 136 are compressed into engagement with the casing in the well bore, the stress in tension stud 15 increases. When the tension in tension stud 15 increases beyond a predetermined level, the stud shears or fractures in reduced diameter portion 64. When stud 15 shears or fractures, the relative movement of the various members or parts of bridge plug 10 ceases.

When slips 226 and packer elements 132, 134 and 136 engage the casing in the well bore and tension stud 15 as sheared or severed, ratchet blocks 280 which are engaged with ratchet grooves 176 on packer mandrel 138 act as first and second ratchet means to prevent any relative movement of upper packer shoe 130, packer elements 132, 134 and 136, lower packer shoe 140 and upper wedge member 186 with respect to J-slot retrieving mandrel 16, bypass body 20, J-slot mandrel 120, packer mandrel 138, lower wedge member 202 and J-slot case 320 which would allow bridge plug 10 to unset or disengage the casing in the well bore.

After tension stud 15 has sheared or severed and bridge plug 10 has been set in the casing in the well bore, the Baker Model "E-4" setting assembly having setting sleeve 12, adapter 14 and the upper portion of tension stud 15 secured thereto are removed from the well bore.

To retrieve bridge plug 10 of the present invention, retrieving tool 500, shown in FIG. 5, is connected to a tubing string and lowered into the casing in the well bore.

Since setting sleeve 12 and adapter 14 are no longer present on the set bridge plug 10 in the casing in the well bore, the end of retrieving tool 500 passes over the top of J-slot retrieving mandrel 16 with lugs 520 of tool 500 engaging entry portion 410 of J-slot 72 in mandrel 16 until ring spring 508 passes over, and engages, the upper surface of annular rib 88 of release valve sleeve 18.

When ring spring 508 engages annular rib 88 of release valve sleeve 18, threaded shear pins 91 retaining sleeve 18 in a first position on release valve body 20 are sheared or severed with a continued downward movement of retrieving tool 500, causing sleeve 18 to move downwardly until end 19 of sleeve 18 abuts shoulder 105 on body 20, at which time ring spring 508 expands slightly and passes over annular rib 88. Concurrently with this action, the plurality of lugs 520 in retrieving tool 500 move through entry portion 410, ramp portion 412 and into lower portion 416 of J-slot 72 in J-slot retrieving mandrel 16.

When the downward movement of retrieving tool 500 over J-slot retrieving mandrel 16 and release valve body 20 is completed with ring spring 508 on, and resiliently engaged by, annular rib 88 of sleeve 18, weight is set down and a right-hand torque is placed on retrieving tool 500 and the tubing string. Shear pin 348 engaging aperture 338 in J-slot mandrel 120 is sheared, thereby allowing relative movement between the J-slot mandrel and J-slot case 320 so that lug 351 on stud 350 on the J-slot case is moved into transition portion 422 of J-slot 336 of J-slot mandrel 120.

Weight is then picked up on the tubing string, raising retrieving tool 500, J-slot retrieving mandrel 16 and J-slot mandrel 120. This upward movement of J-slot mandrel 120 causes fifth cylindrical surface 260 of the J-slot mandrel to contact surfaces 292 of ratchet blocks 280, acting as means for camming the ratchet blocks outwardly from packer mandrel 138, thus releasing ratchet blocks 280 from engagement with ratchet groove 176 of packer mandrel 138.

The release of ratchet blocks 280 allows movement of packer mandrel 138 with respect thereto. Shoulder 333 on J-slot mandrel 120 contacts bottom end 318 of connecting collar 308, thus lifting packer mandrel 138 and upper packer shoe 130, thus returning packer elements 132, 134 and 136 to their original positions and therefore no longer in contact with the casing in the well bore.

Shoulder 167 on packer mandrel 138 contacts shoulder 181 of lower packer shoe 140, thus lifting upper wedge member 186 which causes the top of slips 226 to be disengaged from upper wedge member 186 and possibly from the casing in the well bore.

Lug 351 on stud 350 on J-slot case 320 then moves downwardly through transition portion 422 of J-slot 336 of J-slot mandrel 120. Ramp portion 423 directs lug 351 into lower portion 424 of J-slot 336.

Weight is set down on the tubing string again causing lug 351 of stud 350 to move upwardly in lower portion 424 of J-slot 336 to upper surface 425 thereof, which moves J-slot case 320 and lower wedge member 202 downwardly, thereby disengaging lower wedge member 202 from slips 226. Springs 242 bias slips 226 inwardly thus disengaging the slips from the casing in the well bore.

After completion of a predetermined amount of downward travel of the tubing string having retrieving tool 500 connected thereto, the tubing string and retrieving tool are rotated and moved upwardly in the casing in the well bore. This rotation and upward movement causes lugs 520 on retrieving tool 500 to engage upper portion 414 of J-slot 72 in retrieving J-slot mandrel 16, as shown in FIG. 2, and lug 351 of stud 350 in J-slot case 320 to re-engage lower end 426 of lower portion 424 of J-slot 336 in J-slot mandrel 120, as shown in FIG. 3. Continued upward movement of the tubing string and retrieving tool 500 allows the removal of bridge plug 10 from the casing in the well bore.

It should be noted that after end 19 of release valve sleeve 18 is moved into engagement with shoulder 105 of release valve body 20, any fluid pressure differential across bridge plug 10 may be equalized by fluid flowing through bore 128 in J-slot mandrel 120, through bore 108 in bypass body 20, through apertures 118 in the bypass body, and through apertures 522 in retrieving tool 500. This bypass means facilitates removal of bridge plug 10 from the well bore.

It can be seen, therefore, that the wireline set/tubing retrievable packer type bridge plug of the present invention is well adapted to carry out the ends and advantages mentioned, as well as those inherent therein. While a presently preferred embodiment of the apparatus is discussed for the purposes of this disclosure, it will be seen that numerous changes in the construction of parts, and various modifications and changes in size, shape and materials, may be made by those skilled in the art. Such changes are encompassed within the scope and spirit of the appended claims.

Illustrations of such modifications and changes in bridge plug 10 are integrating or combining ratchet blocks 280 and lower slip member 202 such that the lower slip member has a plurality of interiorly threaded resilient collet fingers on one end thereof to engage ratchet groove 176 on packer mandrel 138, or integrating or combining lower packer shoe 178 and upper wedge member 186, or integrating or combining packer mandrel 138 and connecting collar 308 into one member, or by rearranging the order of components of bridge plug 10, etc.

Also, bridge plug 10 of the present invention could be utilized as a packer by changing release valve sleeve 18 to a different type actuating valve to permit the selective flow of fluids through the packer.

What is claimed is:

1. A retrievable downhole tool for use in a well bore, said tool comprising:

mandrel means having a shaped recess thereon;

packer mandrel means disposed around said mandrel means and comprising first ratchet means thereon;

ratchet body means disposed around said packer mandrel means and comprising second ratchet means thereon for releasably engaging said first ratchet means;

mandrel case means disposed around said mandrel means and having lug means thereon for engaging said shaped recess in said mandrel means;

packer means on said packer mandrel means for releasably, sealingly engaging said well bore; and slip means for releasably, grippingly engaging said well bore.

2. The tool of claim 1 wherein said mandrel case means is shearably attached to said packer mandrel means.

3. The tool of claim 1 wherein said recess and said lug means are positioned below said ratchet body means.

4. The tool of claim 1 wherein said slip means comprises:

upper wedge means;

lower wedge means spaced from said upper wedge means; and a plurality of slips disposed between said upper and lower wedge means and engaged therewith when in a set position.

5. The tool of claim 4 further comprising:

slip retainer means attached to one of said upper and lower wedge means and slidable with respect to the other of said upper and lower wedge means, said slip retainer means defining a plurality of apertures therein for permitting extension of a portion of a corresponding slip therethrough.

6. The tool of claim 4 wherein at least one of said upper and lower wedge means comprises ratchet enclosure means for enclosing and locating said ratchet body means.

7. The tool of claim 1 further comprising bypass means by bypassing fluid therethrough as said tool is retrieved from said well bore.

8. The tool of claim 1 wherein said mandrel means comprises means thereon for selectively engaging said second ratchet means with said first ratchet means and disengaging said second ratchet means from said first ratchet means corresponding to a relative position of said mandrel means with respect to said packer mandrel means.

9. The tool of claim 1 further comprising biasing means for biasing said ratchet body means toward a position in which said second ratchet means is engaged with said first ratchet means.

10. A retrievable bridge plug for use in a well bore, said bridge plug comprising:

a first mandrel having at least one shaped recess therein;

a packer mandrel having a ratchet groove surface thereon;

a ratchet body disposed adjacent said packer mandrel and having a ratchet groove surface thereon corresponding to said ratchet groove surface on said packer mandrel, said ratchet body having a first position in which said ratchet groove surface thereon is engaged with said ratchet groove surface on said packer mandrel and a second position in which said ratchet groove surface thereon is spaced from said ratchet groove surface on said packer mandrel;

a mandrel case disposed around said mandrel and having at least one lug extending inwardly therefrom for engaging said shaped recess in said mandrel;

a packer element disposed around said packer mandrel, said packer element having a set position for resiliently, sealingly engaging said well bore;

an upper wedge member disposed about said packer mandrel and having a downwardly facing frusto-conical surface thereon;

a lower wedge member spaced from said upper wedge member and disposed about said packer mandrel, said lower wedge member having an upwardly facing frusto-conical surface thereon; and a plurality of slips disposed between said upper and lower wedge members.

11. The bridge plug of claim 10 further comprising a slip retainer sleeve having a portion thereof disposed about said upper wedge member and another portion thereof disposed about said lower wedge member, said slip retainer sleeve further defining a plurality of apertures therethrough for permitting a portion of a corresponding slip to extend therethrough for gripping engagement with said well bore.

12. The bridge plug of claim 10 wherein said mandrel comprises:

a J-slot mandrel having said shaped recess therein; and a bypass body attached to said J-slot mandrel.

13. The bridge plug of claim 12 further comprising:

an adapter having a first bore through a portion thereof and a second bore through another portion thereof;

a tension stud having a portion thereof connected to said adapter and another portion connected to said bypass body; and at least one shear pin for releasably retaining said packer mandrel and said upper wedge member in a first position with respect to each other.

14. The bridge plug of claim 10 further comprising a setting sleeve adapted for use when setting said bridge plug in said well bore.

15. The bridge plug of claim 10 further comprising a retrieving tool adapted for use in retrieving said bridge plug from said well bore.

16. The bridge plug of claim 15 wherein said retrieving tool comprises lug means thereon for releasably engaging said shaped recess in said mandrel.

17. The bridge plug of claim 10 wherein said mandrel has a cylindrical surface engaging said ratchet body when said ratchet groove block is in said first position and another cylindrical surface for engaging said ratchet block and displacing said ratchet block to said second position.

18. The apparatus of claim 17 further comprising a spring disposed around said ratchet block for biasing said ratchet block from said second position toward said first position.

19. A retrievable bridge plug for use in a well bore, said bridge plug comprising:

a first mandrel having a plurality of shaped recesses therein;

a packer mandrel disposed around an upper end of said first mandrel and having ratchet grooves on a portion thereof;

a ratchet body disposed around said packer mandrel and having a portion thereof adapted for releasably engaging said ratchet grooves on said packer mandrel;

a packer element disposed around said packer mandrel, said packer element adapted for releasably, resiliently engaging said well bore;

an upper wedge member disposed about said packer mandrel and having a frusto-conical surface on a portion of the exterior thereof;

a lower wedge member disposed about a portion of said packer mandrel having a frusto-conical surface on a portion of the exterior thereof, said lower wedge member defining a ratchet body receiving aperture therethrough for receiving and locating said ratchet body;

a plurality of slips disposed about a portion of said packer mandrel and being axially located between said upper and lower wedge members; and a mandrel case attached to said lower wedge member and shearably connected to said packer mandrel, said mandrel case having a lug thereon for engaging at least one of said shaped recesses in said mandrel.

20. The bridge plug of claim 19 further comprising a retrieving tool adapted for use in retrieving said bridge plug from said well bore and comprising a lug for releasably engaging another of said shaped recesses in said mandrel.

* * * * *

UNITED STATES PATENT AND TRADEMARK OFFICE

CERTIFICATE OF CORRECTION

PATENT NO. : 4,693,309

DATED : September 15, 1987

INVENTOR(S) : Kenneth D. Caskey

It is certified that error appears in the above-identified patent and that said Letters Patent is hereby corrected as shown below:

In column 3, line 48, delete the numeral [16] and insert therefor --15--.

In Column 5, line 26, delete the numeral [108] and insert therefor --180--.

In column 8, line 6, delete the numeral [520] and insert therefor --530--.

Signed and Sealed this

Twenty-ninth Day of December, 1987

*Attest:*

DONALD J. QUIGG

*Attesting Officer*

*Commissioner of Patents and Trademarks*